US006718669B1

(12) United States Patent
Hayes

(10) Patent No.: US 6,718,669 B1
(45) Date of Patent: Apr. 13, 2004

(54) PORTABLE TRADE SHOW EXHIBIT SYSTEM

(75) Inventor: Paul H. Hayes, Addison, TX (US)

(73) Assignee: Bannerbooth.Com, Addison, TX (US)

( * ) Notice: Subject to any disclaimer, the term of this patent is extended or adjusted under 35 U.S.C. 154(b) by 0 days.

(21) Appl. No.: 09/318,648

(22) Filed: May 17, 1999

(51) Int. Cl.[7] ..... G09F 15/00
(52) U.S. Cl. ..... 40/610; 40/603
(58) Field of Search ..... 160/327, 377, 160/387; 40/610, 603, 617

(56) References Cited

U.S. PATENT DOCUMENTS

| | | | | | |
|---|---|---|---|---|---|
| 566,815 | A | * | 9/1896 | Taylor | 160/327 |
| 1,567,674 | A | * | 12/1925 | Pease et al. | 160/387 |
| 3,868,630 | A | | 2/1975 | Lesondak | |
| 4,019,271 | A | | 4/1977 | Latimer | |
| 4,232,466 | A | | 11/1980 | Mathis | 40/606 |
| 4,233,769 | A | | 11/1980 | Archer | 40/607 |
| 4,275,520 | A | | 6/1981 | Appleton et al. | 40/605 |
| 4,512,098 | A | | 4/1985 | Ready et al. | 40/610 |
| 4,642,946 | A | | 2/1987 | Koch | 40/611 X |
| 4,817,319 | A | | 4/1989 | Vitale | 40/610 |
| 4,866,866 | A | | 9/1989 | Rotter et al. | 40/610 |
| 4,875,302 | A | | 10/1989 | Noffsinger | 40/610 |
| 4,878,303 | A | | 11/1989 | Banniza et al. | 40/606 |
| 4,916,840 | A | | 4/1990 | Getz | 40/605 |
| 5,083,390 | A | | 1/1992 | Edman | 40/606 |
| 5,319,870 | A | | 6/1994 | Weiss | 40/606 |
| 5,329,873 | A | | 7/1994 | Tiballi | 40/610 X |
| 5,347,737 | A | | 9/1994 | Theobald, III | 40/610 |
| 5,553,648 | A | * | 9/1996 | Goharjou | 160/377 X |
| 5,561,931 | A | | 10/1996 | Duenkel | 40/606 |
| 5,595,010 | A | | 1/1997 | Fuller et al. | 40/606 |
| 5,737,862 | A | | 4/1998 | Cooper et al. | 40/606 |
| 5,743,037 | A | | 4/1998 | Martin | 40/610 |
| 5,815,966 | A | * | 10/1998 | Vestevich | 40/610 X |
| 5,839,705 | A | | 11/1998 | LaMotte | |
| 5,865,627 | A | | 2/1999 | Foresman | |
| 5,895,024 | A | * | 4/1999 | Williams et al. | 40/610 X |
| 6,038,802 | A | * | 3/2000 | Tidwell | 160/377 X |

* cited by examiner

*Primary Examiner*—William L. Miller
(74) *Attorney, Agent, or Firm*—Jenkens & Gilchrist, PC

(57) ABSTRACT

A portable exhibit system including a graphic panel and collapsible frame is provided that overcomes the shortcoming associated with traditional display systems by being inexpensive, downwardly modular, and easily assembled and disassembled. The graphic panel includes a display surface having a pole pocket within which is inserted a connected set of poles that are also attached to one another by at least one resilient cord which aids in the collapsibility and portability of the graphic panel. The collapsible frame includes a set of base supports that are respectively connected to a set of support hubs, where the support hubs horizontally support a base support pole and each support hub vertically supports an upright pole. Each upright pole has a first end coupled to each support hub and a second end used to support the connected set of poles associated with the graphic panel.

5 Claims, 17 Drawing Sheets

PORTABLE TRADE SHOW EXHIBIT SYSTEM

BACKGROUND OF THE INVENTION

1. Technical Field of the Invention

The present invention generally relates to display systems and accessories and, in particular, to a portable exhibit system including a graphic panel and a collapsible frame.

2. Description of Related Art

It is common for manufacturing and service businesses to set up temporary displays to show their products and services at trade shows, conventions and the like. The types of displays vary greatly and can include a simple presentation panel, a single booth or an elaborate combination of booths that extend over a large area. The traditional display typically involves one or more tables on which information or samples are presented, together with a vertical graphic display on which, for example, company logos and product information are illustrated. In addition, the traditional portable displays are generally modular which enables them to be set up quickly, as in a convention hall, and this modularity also enables them to be quickly removed at the end of the show.

Unfortunately for even the simplest of the traditional portable displays, substantial cost and time are involved in the manufacturing, shipping, assembling and disassembling of these displays. As a result, there exists a need for a less expensive, modular and easily erectable portable exhibit system which can be arranged in different configurations as different portable display needs arise.

BRIEF DESCRIPTION OF THE INVENTION

The present invention overcomes the shortcomings associated with the traditional portable displays by providing a portable exhibit system that includes a graphic panel and collapsible or disassembleable frame which are inexpensive, easily erectable and downwardly modular. The graphic panel includes a display surface having one or more pole pockets within which is inserted a connected set of poles that are also attached to one another by at least one resilient cord which aids in the dismantability and portability of the graphic panel. The frame includes a set of base supports that are respectively connected to a set of support hubs, where the support hubs horizontally support a base support pole and each support hub vertically supports an upright pole. Each upright pole has a first end coupled to each support hub and a second end used to support the connected set of poles associated with the graphic panel.

BRIEF DESCRIPTION OF THE DRAWINGS

A more complete understanding of the method and apparatus of the present invention may be had by reference to the following detailed description when taken in conjunction with the accompanying drawings wherein.

DETAILED DESCRIPTION OF THE DRAWINGS

Figure 1:
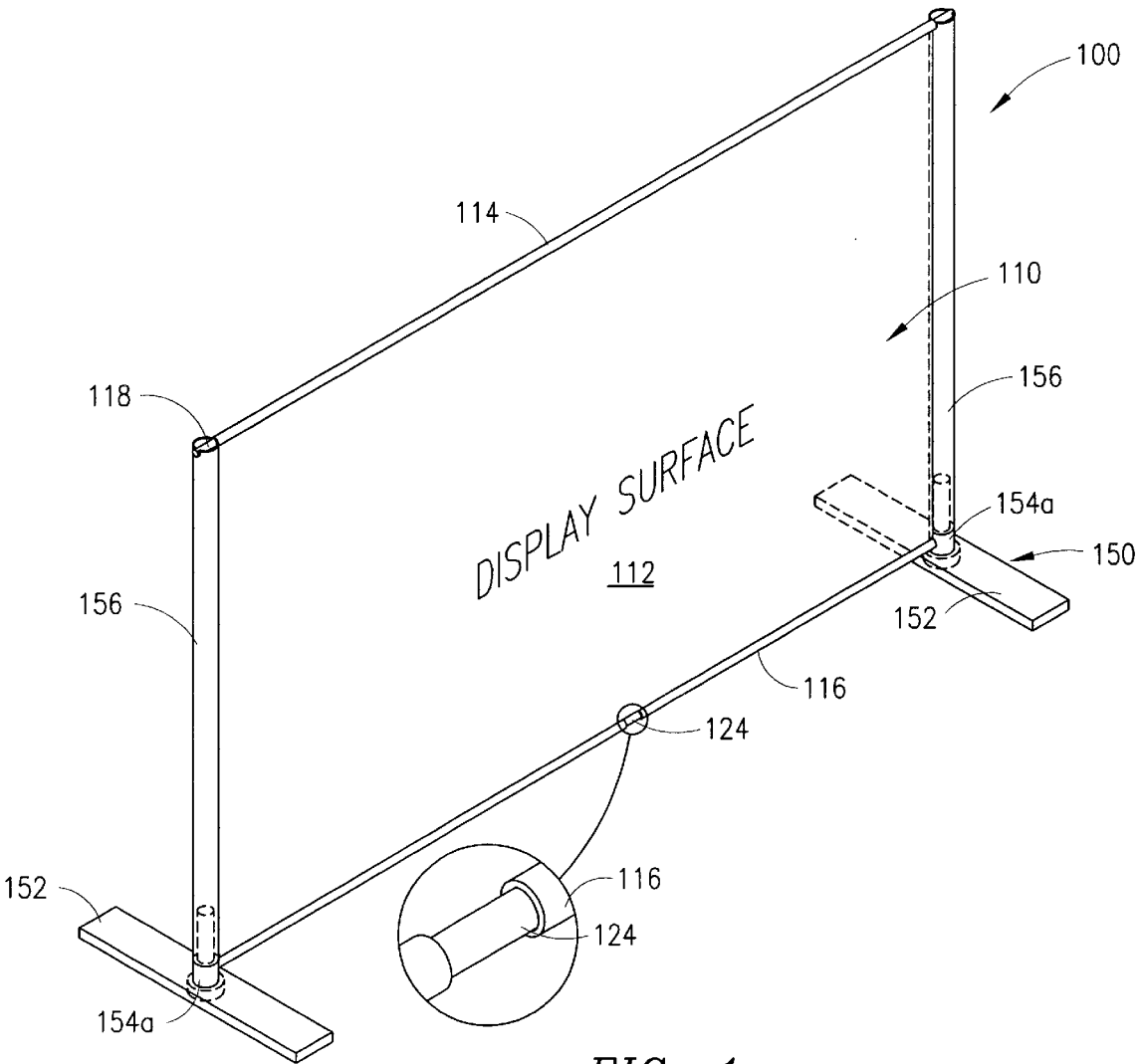
FIG. 1 is a perspective view of a first embodiment of a portable exhibit system including a graphic panel and a dismantable frame of the present invention.

Referring to the Drawings, wherein like numerals represent like parts throughout FIGS. 1–12*m*, there are disclosed four embodiments of an exemplary portable exhibit system in accordance with the present invention.

Although four embodiments of the portable exhibit system will be described, it should be understood that such embodiments are only four of many utilizing the principles of the present invention. Accordingly, the portable exhibit system should not be construed in a limited manner.

Basically, the portable exhibit system is an inexpensive, lightweight, modular and easily erectable and disassembleable exhibit system which can be arranged in a variety of different configurations depending on the requirements of a particular display. Moreover, the portable exhibit system is downwardly modular wherein the components of larger displays (see FIG. 10) can also be used to build smaller displays (see FIGS. 1, 4 and 8) as described in detail later. It is noted that an exemplary embodiment of the portable display system can further be manufactured of disposable materials such as paper, cardboard, paper products, light plastic products and tubing with a graphic panel made of a light flexible material like paper products, Mylar, plastic, polyethylene film, screen materials or any other lightweight similar product.

Figure 2:
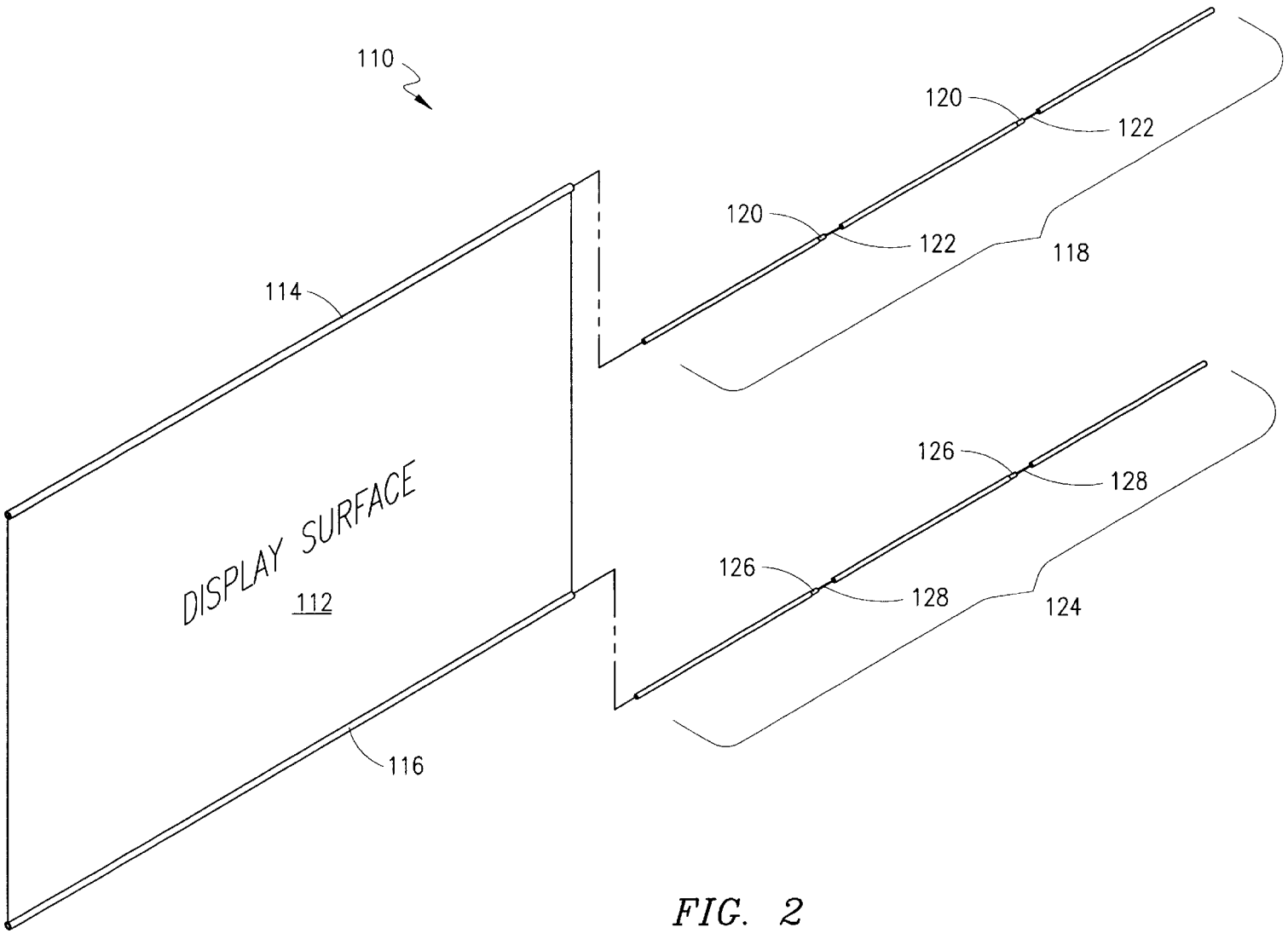
FIG. 2 is an exploded view of the graphic panel shown in FIG. 1.
Figure 3:
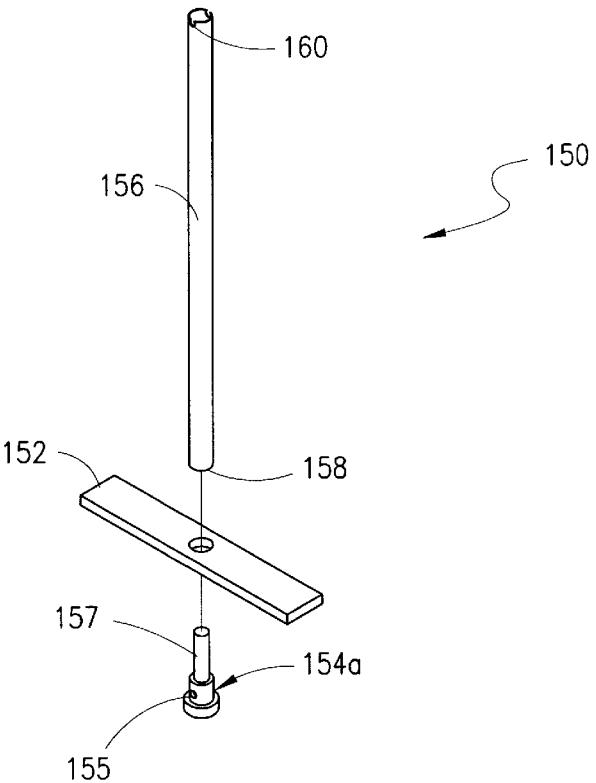
FIG. 3 is an exploded view of the frame shown in FIG. 1.
Figure 3:
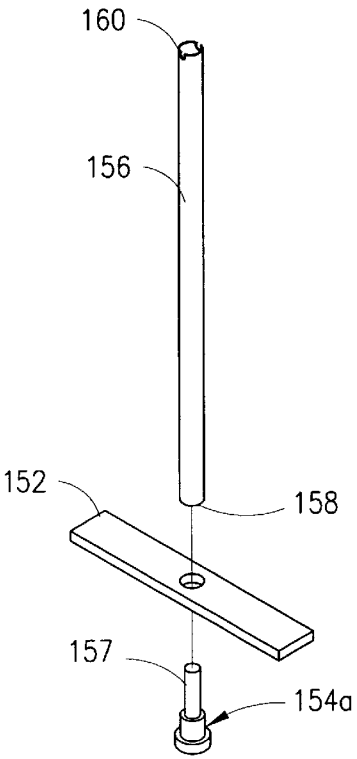
Figure 4:
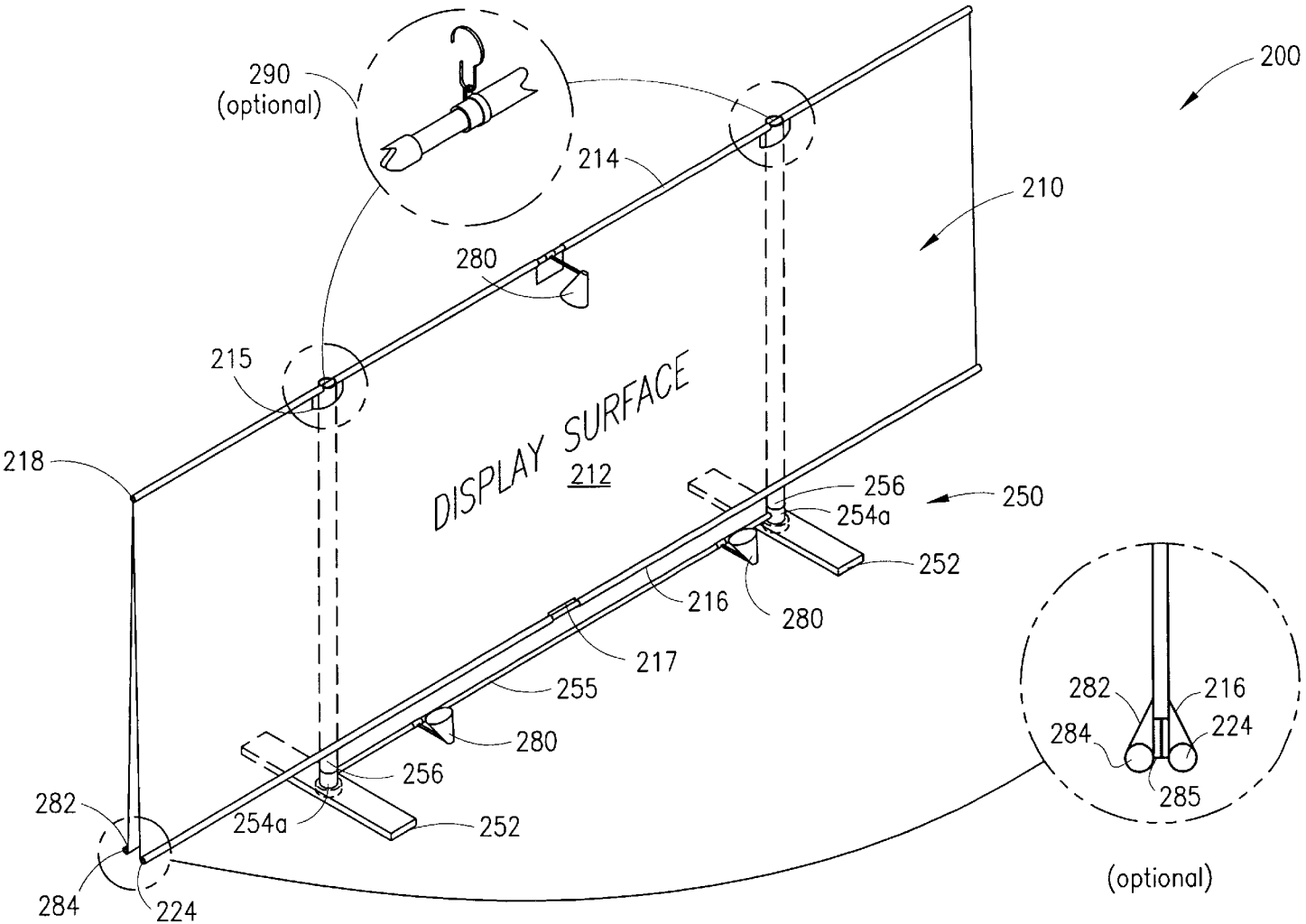
FIG. 4 is a perspective view of a second embodiment of the portable exhibit system including the graphic panel and the frame of the present invention.
Figure 5:
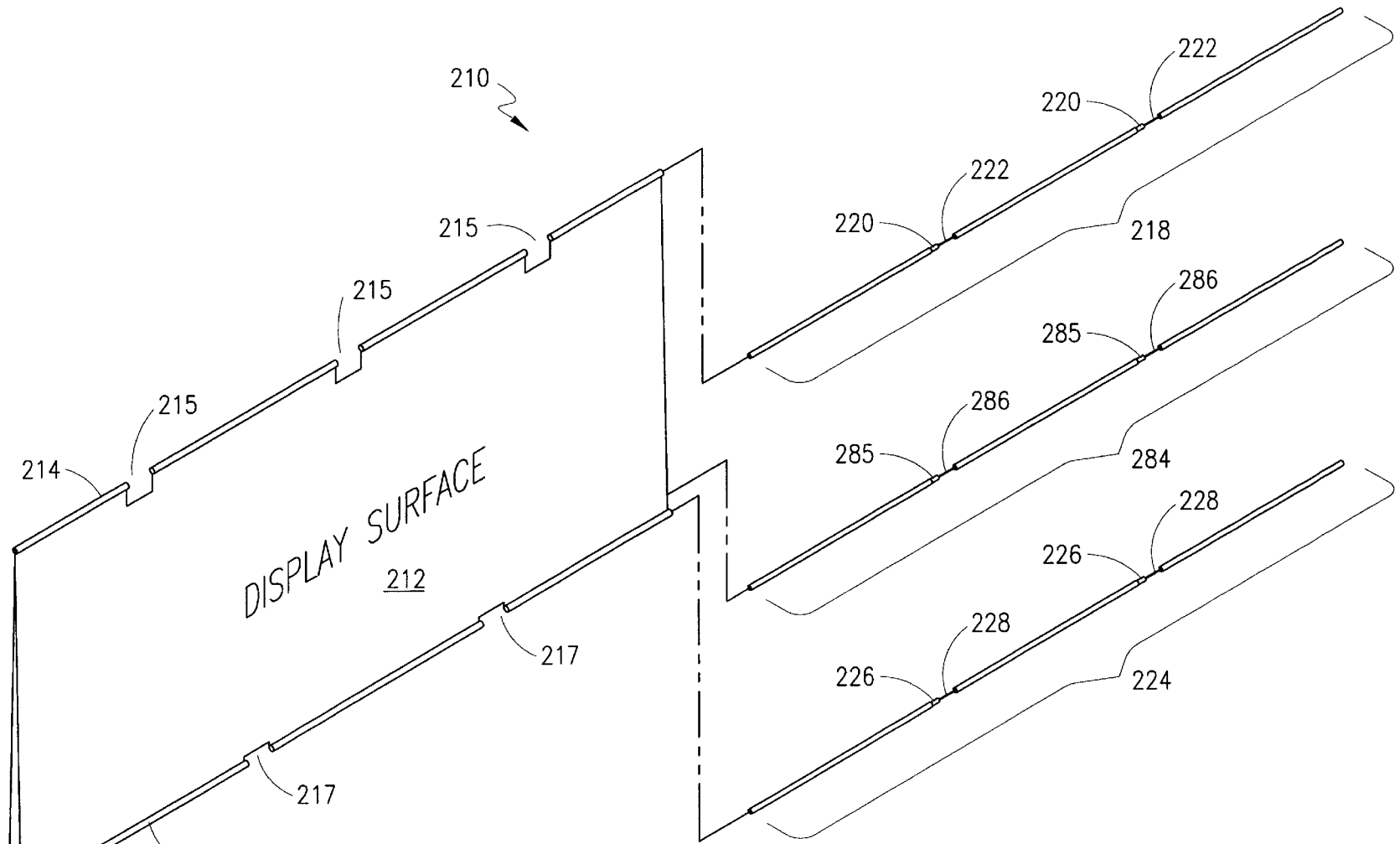
FIG. 5 is an exploded view of the graphic panel shown in FIG. 4.
Figure 6:
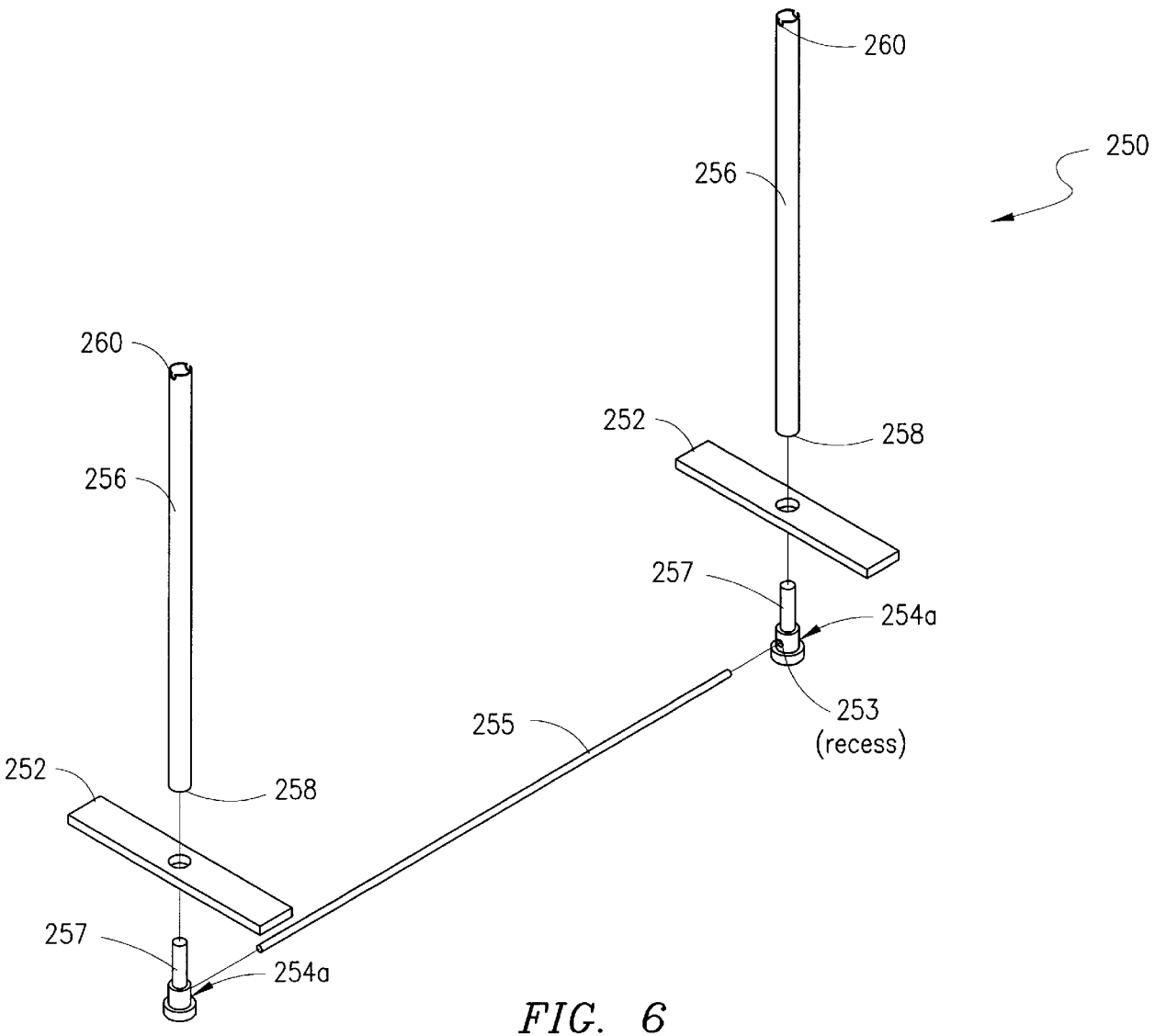
FIG. 6 is an exploded view of the frame shown in FIG. 4.

Referring to FIGS. 1–3, there are illustrated different views of a first embodiment of the portable exhibit system 100 including a graphic panel 110 and a collapsible frame 150. The portable exhibit system 100 shown is one of the less elaborate displays in accordance with the present invention which can be placed on top of a table (see FIG. 12*a*).

The graphic panel 110 includes a display surface 112 having a first pole pocket 114 and a second pole pocket 116 each of which can be formed from looping and threading or heatseaming, RF seaming, gluing, etc., an edge of the display surface. A first set of poles 118 are coupled to one another using slip fittings 120 and inserted into the first pole pocket 114. The first set of poles 118 are also connected to one another by a first internal cord 122 that allows for the easy assembly and disassembly of the first set of poles 118 and improves the portability of the graphic panel 110. The first internal cord 122 can be a single cord routed within the first set of poles 118 or it can be separate cords attached between each pair of poles.

Likewise, a second set of poles 124 are coupled to one another using slip fittings 126 and inserted into the second pole pocket 116. The second set of poles 124 are also connected to one another by a second internal cord 128 which aids in the storage and portability of the graphic panel 110 by attaching the poles 128 to one another in a predetermined manner. As above, the second internal cord 128 can be a single cord routed within the second set of poles 124 or it can be separate cords attached between each pair of poles.

The first and second set of poles 118 and 124 can be constructed from lightweight materials such as aluminum, plastic, paper products, or fiberglass and, furthermore, each pole can be constructed as either a solid pole or hollow pole. Moreover, the first and second internal cords 122 and 128 may be manufactured from a resilient material to aid in the portability of the first and second set of poles 118 and 124, respectively. Also, it should be understood that the display surface 112 can be manufactured such that an outdoor exhibition setting is possible because the display surface may be designed to allow the wind to pass therethrough.

Figure 10:
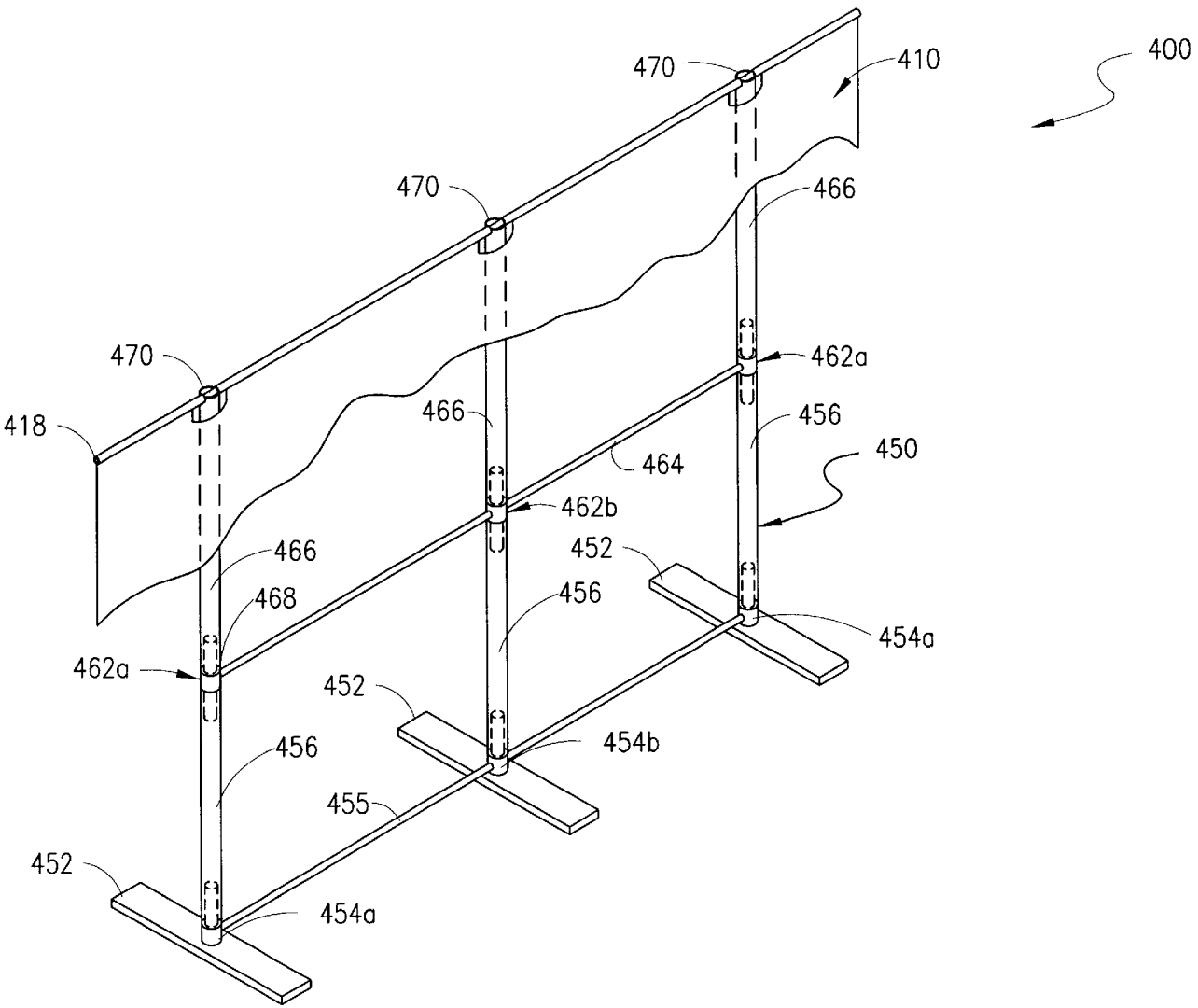
FIG. 10 is a perspective view of a fourth embodiment of the portable exhibit system including the graphic panel and an exemplary frame of the present invention.

The collapsible frame 150 operates to support the graphic panel 110 and includes a pair of base supports 152 each of which is connected to or integral with a support hub 154*a* (compare to support hub 454*b* of FIG. 10). Each support hub 154*a* is configured to horizontally support within a recess 155 (for example) one end of the connected second set of poles 124 and vertically support an upright pole 156 on an extension 157. The upright poles 156 each include a first end 158 connected to the extension 157 of the support hubs 154*a* and a second end 160 that supports the connected first set of poles 118 of the graphic panel 110. For example, each second end 160 may include a groove (shown) or a hole (not shown) for supporting the connected first set of poles 118 of the graphic panel 110.

Referring to FIGS. 4–7, there are illustrated different views of a second embodiment of the portable exhibit system 200 including a graphic panel 210 and a collapsible frame 250. The portable exhibit system 200 is similar to the first embodiment except that the graphic panel 210 is now capable of supporting one or more lights, and that a bottom portion of the graphic panel 210 is not connected to the collapsible frame 250. In addition, the graphic panel 210 as illustrated is larger than the collapsible frame 250 instead of being slightly smaller than the collapsible frame as illustrated in the first embodiment.

The graphic panel 210 includes a display surface 212 having a first pole pocket 214 and a second pole pocket 216 each of which can be formed from looping and threading an edge of the display surface. A first set of poles 218 are coupled to one another using slip fittings 220 and inserted into the first pole pocket 214. To aid with the insertion of the first set of poles 218 into the first pole pocket 214, the first pole pocket 214 can have formed therein at least one notch 215 (only three shown).

The first set of poles 218 are also connected to one another by a first internal cord 222 that allows for the easy assembly and disassembly of the first set of poles 218 and improves the portability of the graphic panel 210. Similar to the first embodiment, the first internal cord 222 can be a single cord routed within the first set of poles 218 or it can be separate cords attached between each pair of poles.

Likewise, a second set of poles 224 are coupled to one another using slip fittings 226 and inserted into the second pole pocket 216. To aid with the insertion of the second set of poles 224 into the second pole pocket 216, the second pole pocket 216 can have formed therein at least one notch 217 (only one shown). At least one notch 217 is preferably placed in the center of the pole pocket. The notch 217 aides in accomplishing specific benefits. In particular, the notch (es) 217 aid in rolling the display surface 212. The notch aids a user in rolling the display surface both straight and tight by providing a variation in thickness of the display material. The notch may also provide an easy location for folding the graphic panel prior to rolling. As above, the second set of poles 224 are also connected to one another by a second internal cord 228 which aids in the storage and portability of the graphics panel 210 by attaching the poles 224 to one another in a predetermined manner. The second internal cord 228 can be a single cord routed within the second set of poles 224 or it can be separate cords attached between each pair of poles.

As an option, the display surface 212 can be configured to allow graphics to be displayed on two sides of the graphic panel 210 (as shown). More specifically, the display surface 212 can include a third pole pocket 282 located near to and attached (if desired) to the second pole pocket 216 when the graphic panel 210 is supported on the collapsible frame 250. In other words, the second and third pole pockets 216 and 282 are located at opposite ends of the display surface 212 while the first pole pocket 214 is located between the second pole pocket and the third pole pocket. The second and third pole pockets 216 and 282 can be attached to one another using fasteners 287 such as buttons or Velcro.

Assuming the display surface 212 is configured to have graphics displayed on two sides, then the graphic panel 210 includes a third set of poles 284 coupled to one another using slip fittings 285 and inserted into the third pole pocket 282. The third set of poles 284 are connected to one another by a third internal cord 286 which is similar to the first and second internal cords 222 and 228 described above. In addition, the third pole pocket 282 can have formed therein at least one notch (none shown) to aid with the insertion of the connected third set of poles 284 into the third pole pocket 282. of course, it is possible to have graphics on both sides of the display surface 112 associated with the first embodiment.

The first, second, and third set of poles 218, 224 and 284 enable the display surface 212 to hang relatively straight and can be constructed from lightweight materials such as aluminum, plastic, or fiberglass. As in the first embodiment, each pole 218, 224 and 284 can be constructed as either a solid pole or hollow pole, and the first, second and third internal cords 222, 228 and 286 can be constructed from a resilient material.

The collapsible frame 250 operates to support the graphic panel 210 and includes a pair of base supports 252 each of which is connected to or integral with a support hub 254*a*. Each support hub 254*a* is configured to horizontally support within a recess 253 one end of a base support pole 255 (compare to the connected second set of poles 124 of FIGS. 1–2) and vertically support an upright pole 256 on an extension 257. The upright poles 256 each include a first end 258 connected to the extension 257 of the support hub 254*a* and a second end 260 that supports the connected first set of poles 218 of the graphic panel 210. For example, each second end 260 may include a groove (shown aligned with the notches 215) or a hole (not shown) for supporting the connected first set of poles 218 of the graphic panel 210.

Figure 7:
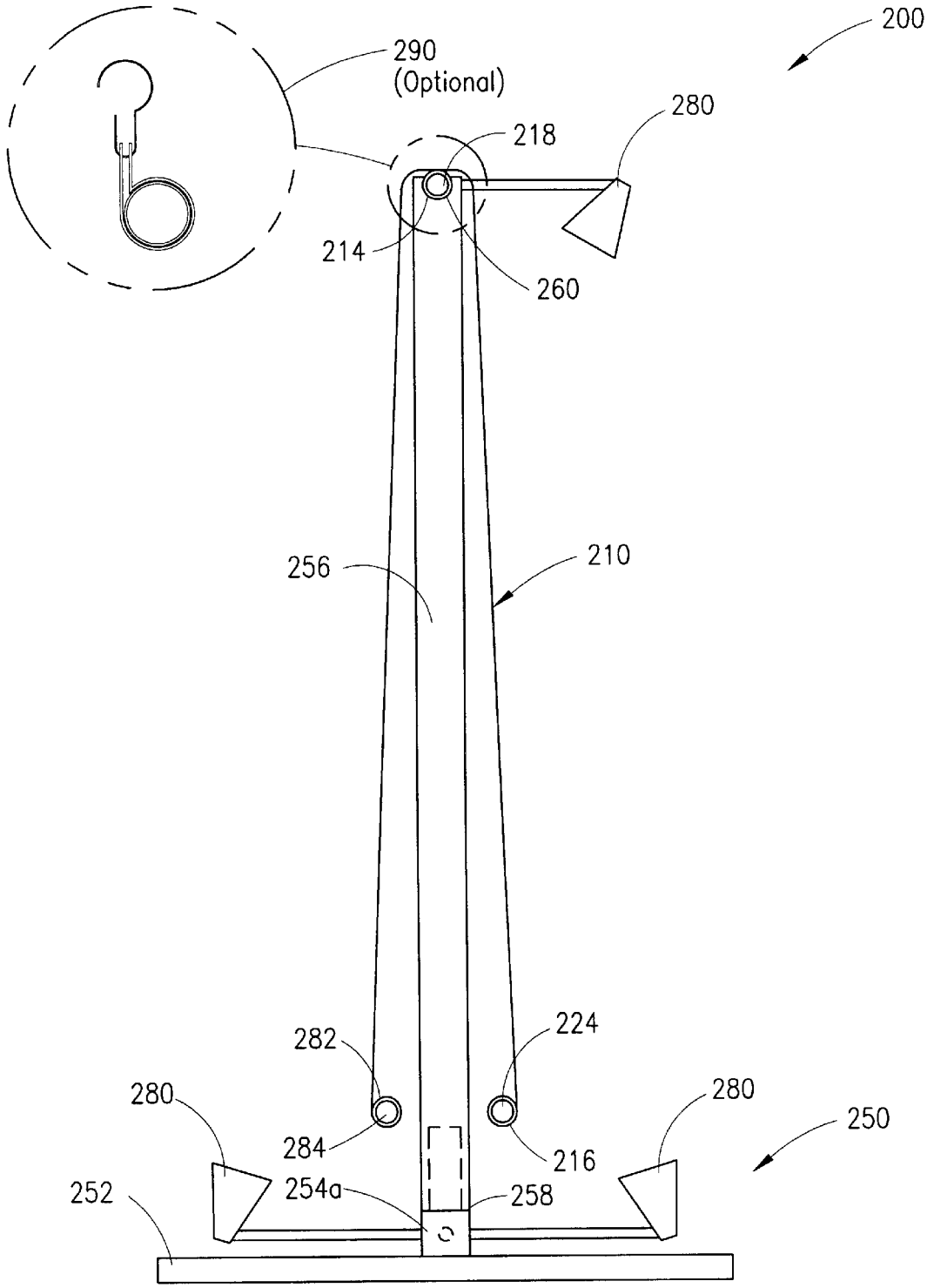
FIG. 7 is a side view of the portable exhibit system shown in FIG. 4.

Furthermore, a light 280 can be connected or removably attached to the respective set of poles 218 and 255. The light 280 (only two bottom lights are shown in FIG. 7) can be attached to the second or third set of poles 224 and 284 at the bottom of the graphic panel 210 to provide the desired 'up-lighting' on the display surface 212. Similarly, the light 280 can be attached to the first set of poles 218 and used to provide the desired down-lighting on the display surface 212. Of course, any combination of lighting including the use of the bottom lights 280 alone may be provided for depending on the needs of the particular display.

In addition, the graphic panel 210 can be hung onto an existing pole and drape assembly using hangers 290 (see FIGS. 4 and 7) instead of hanging the graphic panel on the collapsible frame 250. It should also be understood that by allowing the bottom portion of the graphic panel 210 to hang "free" effectively allows easy access to the rear of the graphic panel where material can be stored.

Figure 8:
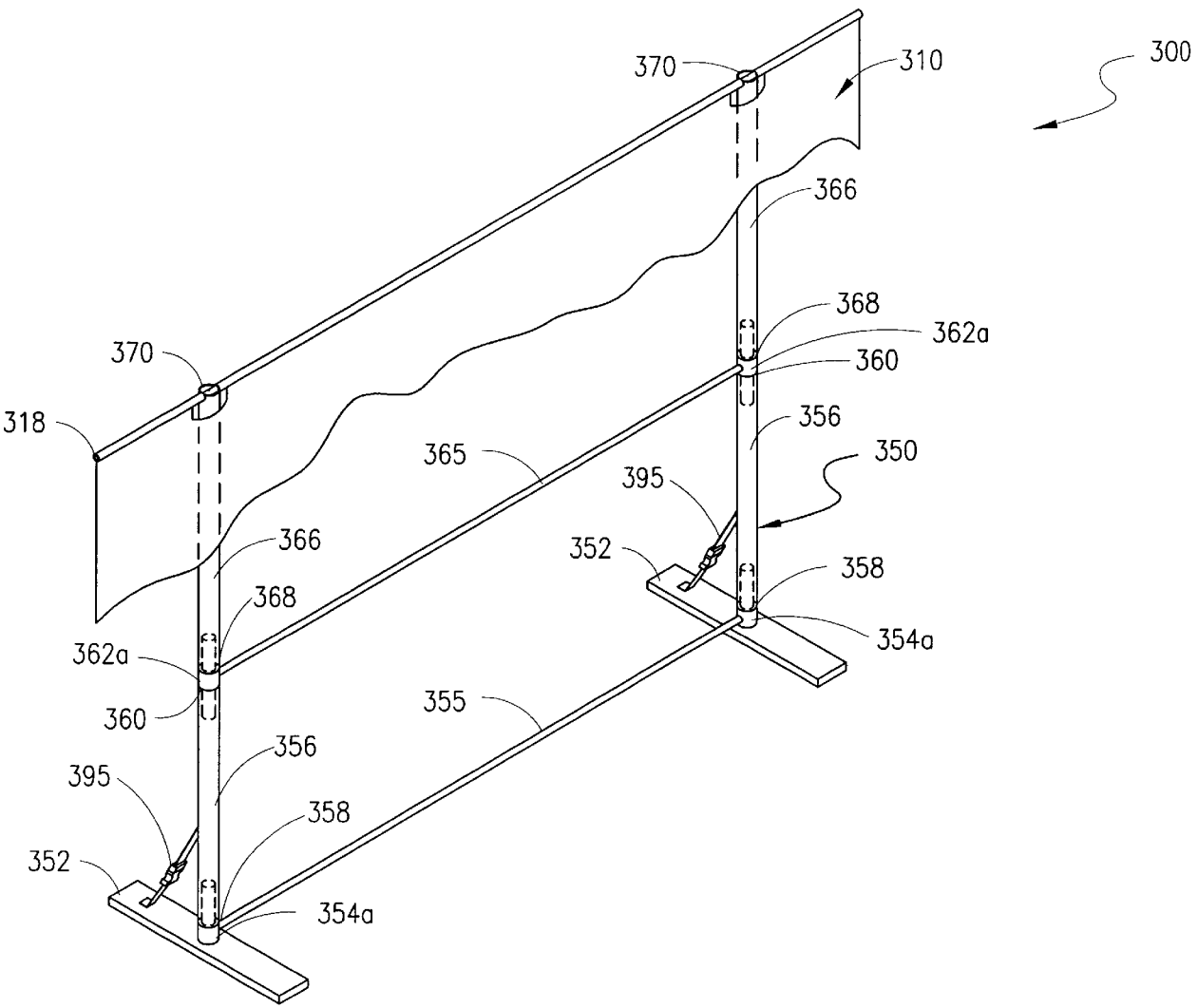
FIG. 8 is a perspective view of a third embodiment of the portable exhibit system including the graphic panel and the frame of the present invention.
Figure 9:
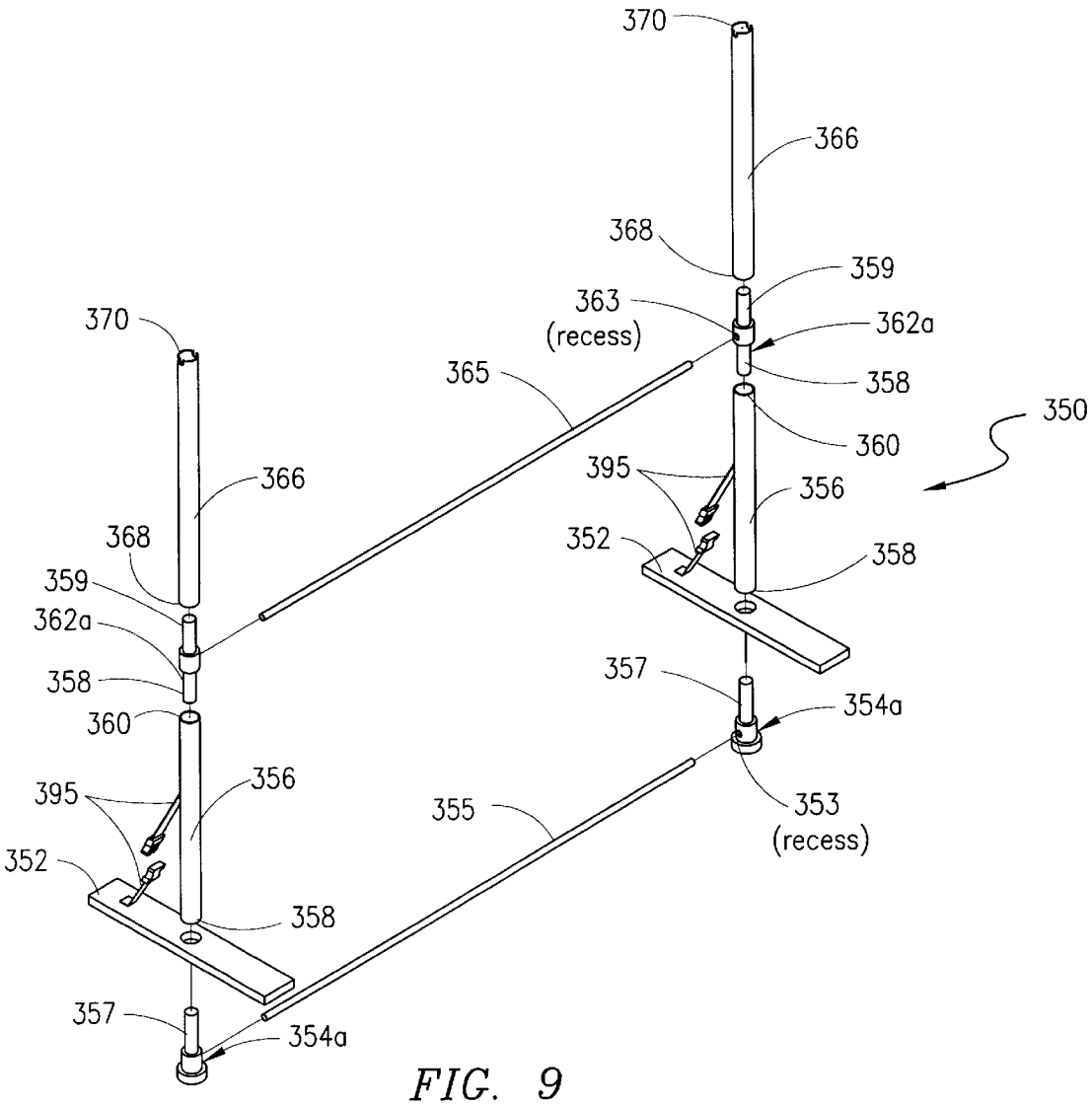
FIG. 9 is an exploded view of an exemplary frame shown in FIG. 8.

Referring to FIGS. 8–9, there are illustrated different views of a third embodiment of the portable exhibit system 300 including a graphic panel 310 and a collapsible frame 350. The portable exhibit system 300 is similar to the second embodiment except that the collapsible frame 350 is expandable in an upward direction to allow for higher displays. To avoid repetition, the graphic panel 310 is not described in detail below since it has basically the same structure and functionality as the graphic panel 210 described above with respect to the second embodiment.

The collapsible frame 350 that supports the graphic panel 310 includes a pair of base supports 352 each of which is coupled to or integral with a support hub 354*a*. Each support hub 354*a* is configured to horizontally support within a recess 353 one end of a base support pole 355 and vertically support a first upright pole 356 on an extension 357. The first upright poles 356 each have a first end 358 connected to the extension 357 of the support hub 354*a* and a second end 360 connected to an extension 358 of an expansion hub 362*a* (compare to expansion hub 362*b* of FIGS. 10–11). Each expansion hub 362*a* is configured to horizontally support within a recess 363 one end of an intermediate support pole 365 and vertically support a second upright pole 366 on an extension 359. The second upright poles 366 each include a first end 368 connected to the extension 359 of the expansion hub 362*a* and a second end 370 that supports the connected first set of poles 318 of the graphic panel 310.

It should be understood that the collapsible frame 350 can be further expanded to any desired height simply by adding another layer (or more), each layer includes expansion hubs, an intermediate support pole and upright poles similar to the ones described above. Furthermore, it should also be understood that straps 395 can be used to help support the first upright poles 356 to the base supports 252.

Figure 11:
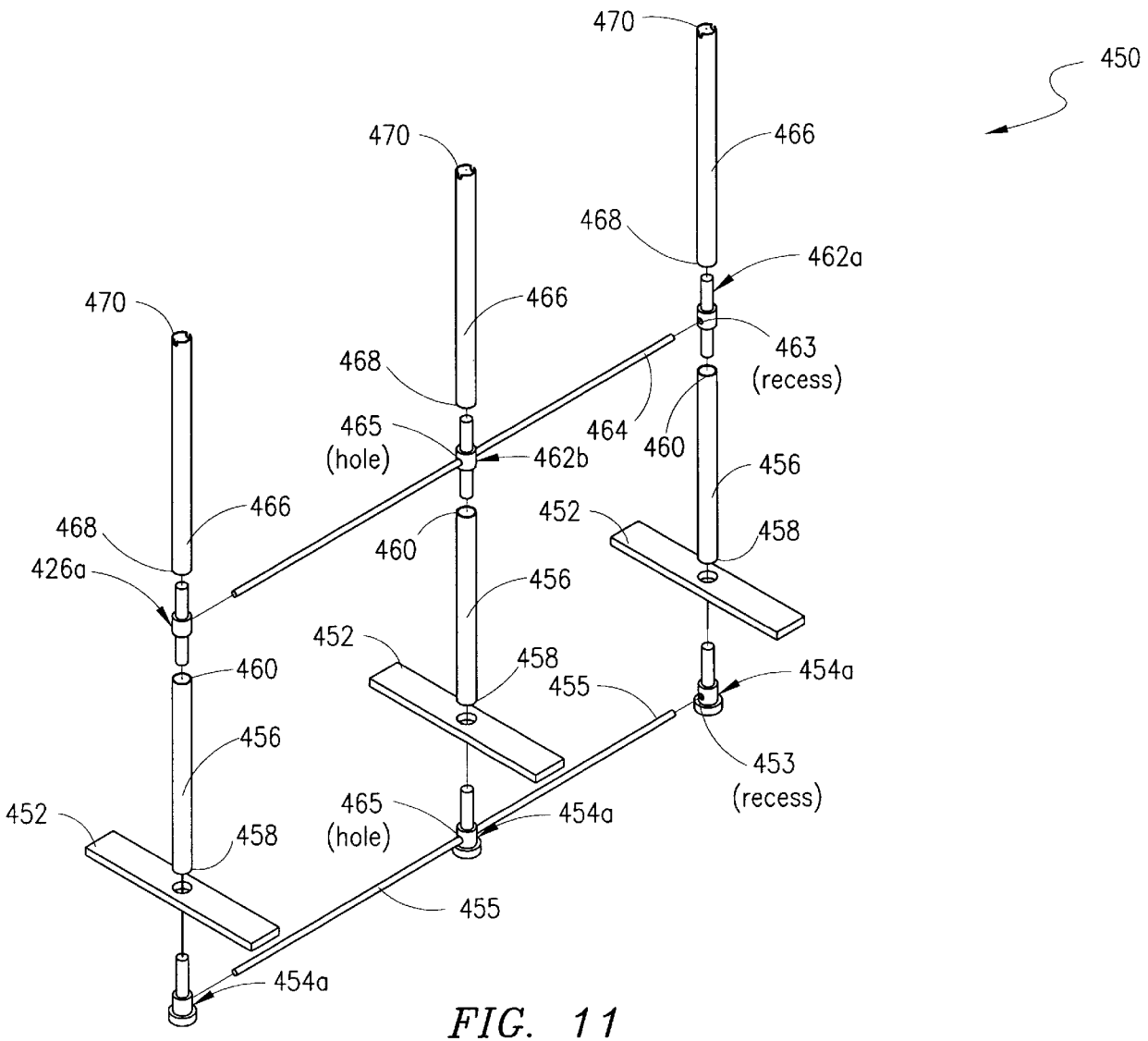
FIG. 11 is an exploded view of the exemplary frame shown in FIG. 10.

Referring to FIGS. 10–11, there are illustrated different views of a fourth embodiment of the portable exhibit system 400 including a graphic panel 410 and a collapsible frame 450. The portable exhibit system 400 is similar to the second and third embodiments except that the collapsible frame 250 is expandable in a direction that allows for wider displays. Again, in order to avoid repetition, the graphic panel 410 is not described in detail below since it has basically the same structure and functionality as the graphic panel 210 described above with respect to the second embodiment.

The collapsible frame 450 that supports the graphic panel 410 can include three or more base supports 452 (only three shown) each of which is coupled to a support hub 454*a* or 454*b*. As shown, two support hubs 454*a* are located at the ends of the collapsible frame 450, and one support hub 454*b* is located between the two support hubs 454*a*. Support hubs 454*a* each include a recess 453 within which is inserted one end of the base support pole 455 while the middle support hub 454*b* includes a hole 456 through which the base support pole is routed.

Each support hub 454*a* and 454*b* is configured to horizontally support the base support pole 455 and vertically support a first upright pole 456. The first upright poles 456 each have a first end 458 connected to the support hub 454*a* or 454*b* and a second end 460 connected to an expansion hub 462*a* or 462*b*. Like the support hubs 454*a* and 454*b*, the expansion hubs 462*a* each include a recess 463 within which is inserted an end of the intermediate support pole 464 while the expansion hub 462*b* includes a hole 465 through which the intermediate support pole is routed.

Each expansion hub 462*a* or 462*b* is configured to horizontally support the intermediate support pole 464 and vertically support a second upright pole 466. The second upright poles 466 each have a first end 468 connected to one of the expansion hubs 462*a* or 462*b* and a second end 470 that supports the connected first set of poles 418 of the graphic panel 410.

Of course, the collapsible frame 450 can be expanded to any desired height and any desired width simply by adding additional components that have been described with respect to the third and fourth embodiments. For example, the collapsible frame 250 (second embodiment) can be widened by using the support hubs 454*b* and additional base supports 452.

Referring to FIGS. 12*a*–12*m*, there are illustrated several perspective views of various displays that can be formed by using one or more of the portable exhibit systems. For clarity, the various displays shown use the first and second embodiments of the portable exhibit system 100 and 200, however, it should be understood that the third and fourth embodiments in addition to other configurations of the portable exhibit system can be used to form the various displays.

Figure 12A:
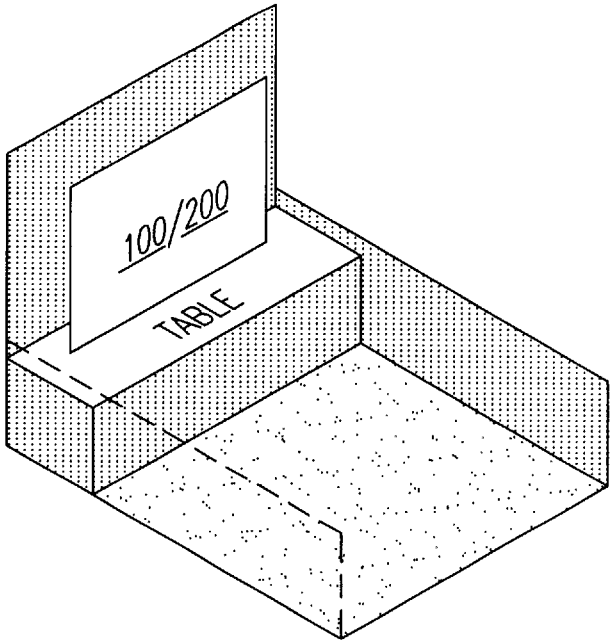
FIGS. 12*a*–12*m* are perspective views of exemplary displays that can be formed by using one or more of the portable exhibit systems.

Referring to FIG. 12*a*, there is illustrated the portable exhibit system used on top of a table. The straight-line profile of the portable exhibit system (e.g., see FIGS. 1 or 4) allows for the storage of literature and product samples behind the graphic panel, while still providing an excellent visual impact.

Figure 12B:
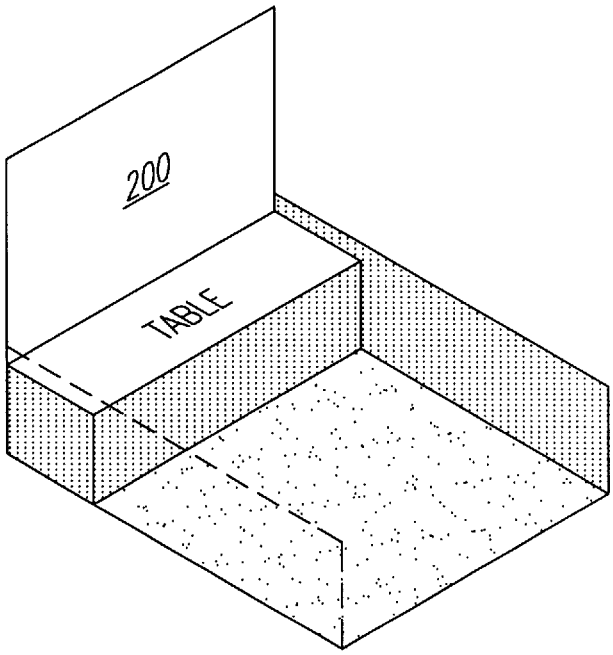

Referring to FIG. 12*b*, there is illustrated the portable exhibit system used behind a table. The graphic panel may be suspended from either the collapsible frame or from a pole and drape using the hangers (see FIGS. 4 and 7).

Figure 12C:
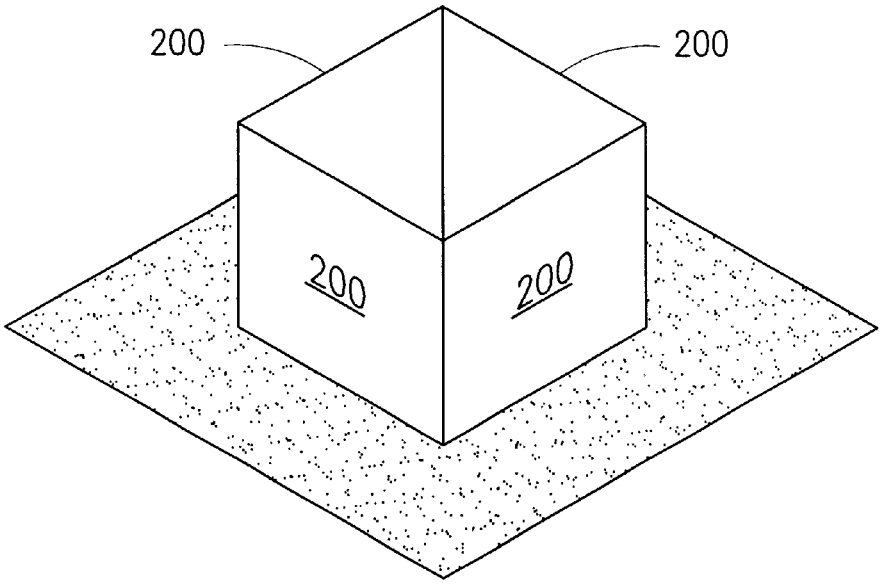

Referring to FIG. 12*c*, there is illustrated four of the portable exhibit systems used together to form a cube display. The cube display enables items such as products and literature to be stored therein, while still maintaining the benefit of traffic flow on all four sides.

Figure 12D:
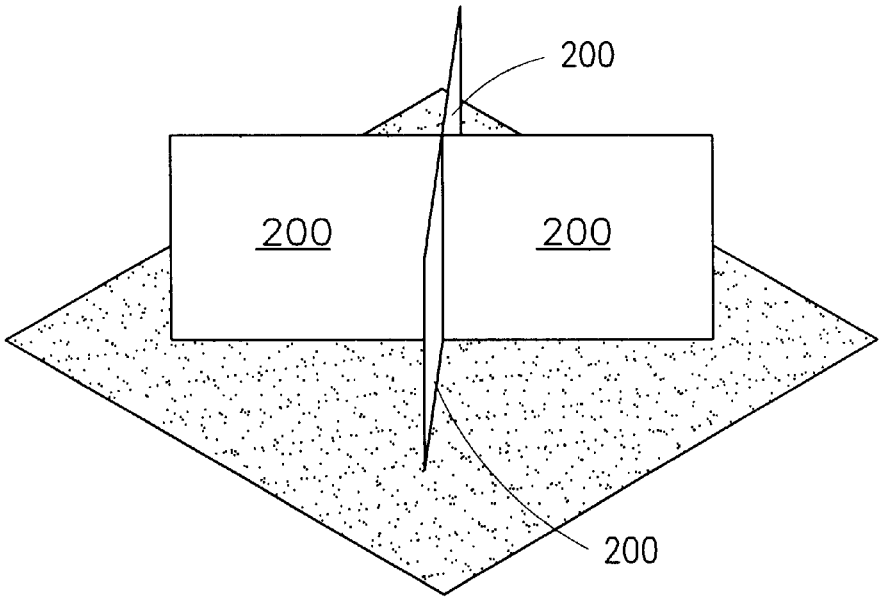

Referring to FIG. 12*d*, there is illustrated four of the portable exhibit systems used together to form an 'X' island display. Each portable exhibit system can have graphics on both sides of the display panel to ensure a direct line of sight between the graphic message and visitors passing the display in every direction.

Figure 12E:
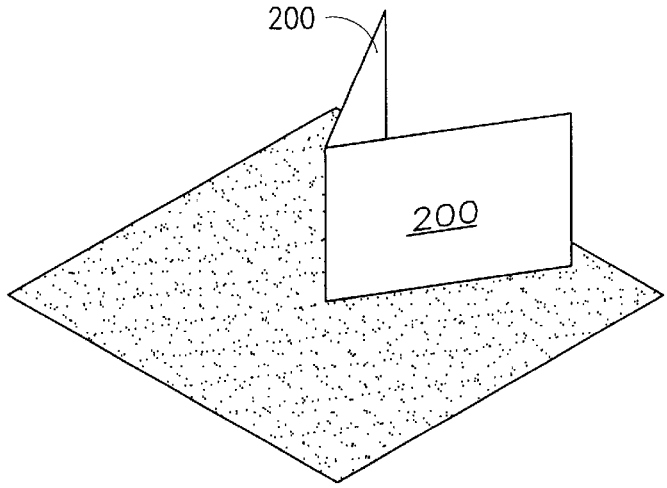

Referring to FIG. 12*e*, there is illustrated two of the portable exhibit systems used together to form a 'V' storage display. The 'V' storage display is ideal for storage purposes since the storage space is easily accessible simply by raising the bottom portion of the graphic panel (see FIG. 2).

Figure 12F:
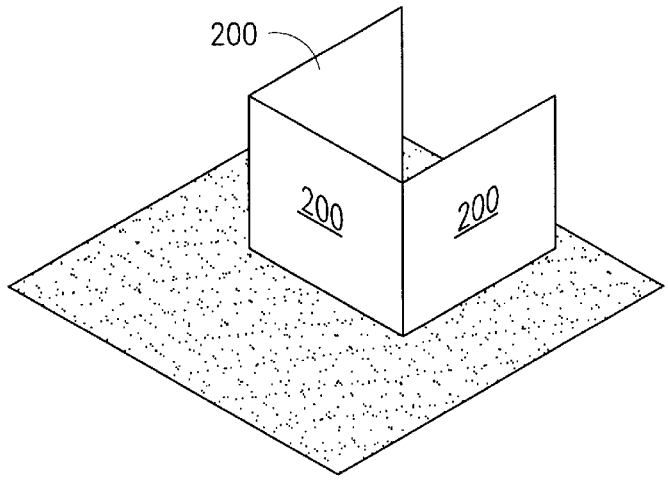

Referring to FIG. 12*f*, there is illustrated three of the portable exhibit systems used together to form a 'U' storage display. The 'U' storage display provides for optimal storage area for an end-of-aisle exhibit area while still complying with line-of-sight desires.

Figure 12G:
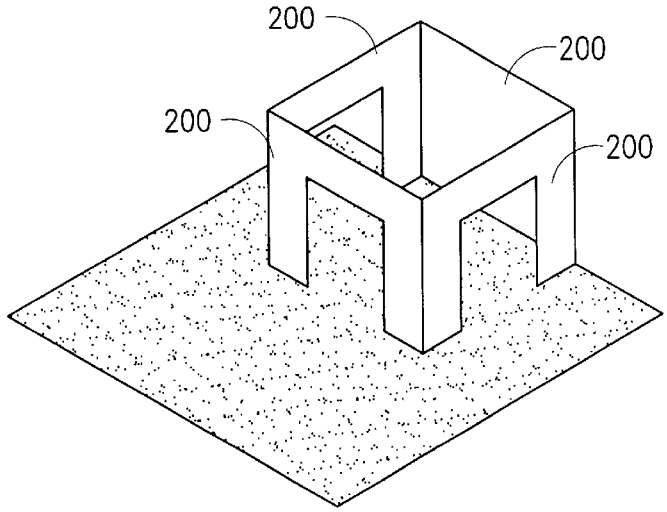

Referring to FIG. 12*g*, there is illustrated four of the portable exhibit systems used together to form a conference room. Several of the portable exhibit systems have walkways cutout of the display surface to enable visitors to enter and exit the conference room.

Figure 12H:
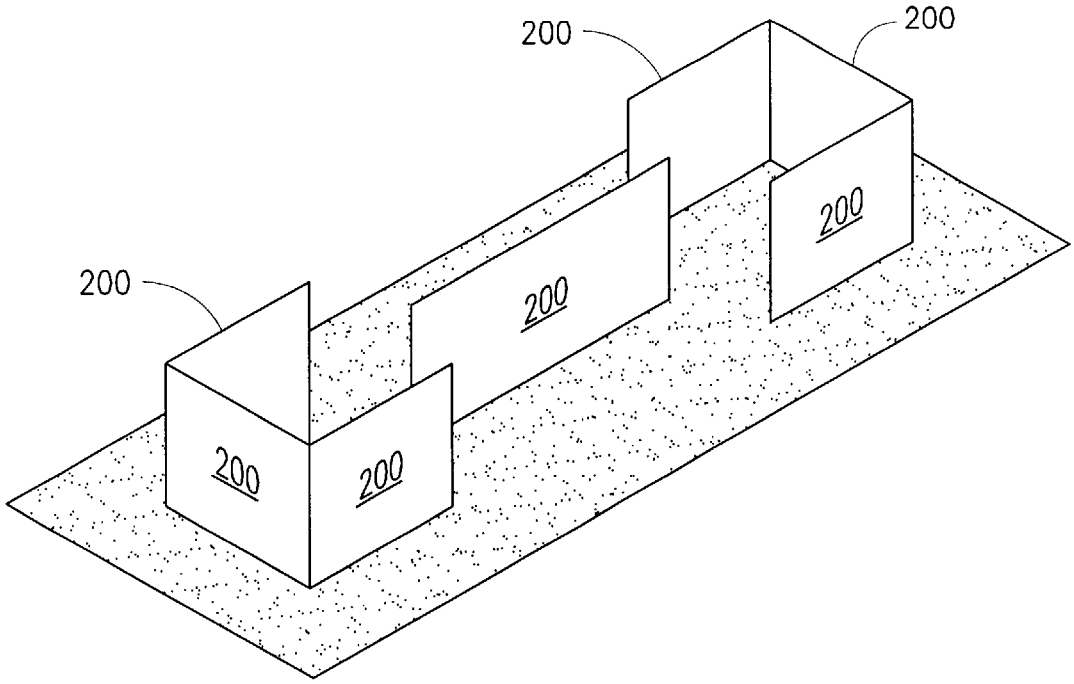

Referring to FIG. 12*h,* there is illustrated seven of the portable exhibit systems used together to form a dual conference room. The dual conference room contains two private conference areas of which the display surfaces can be made of a very fine mesh so that exhibitors can maintain awareness of what is going on outside of the conference areas.

Figure 12I:
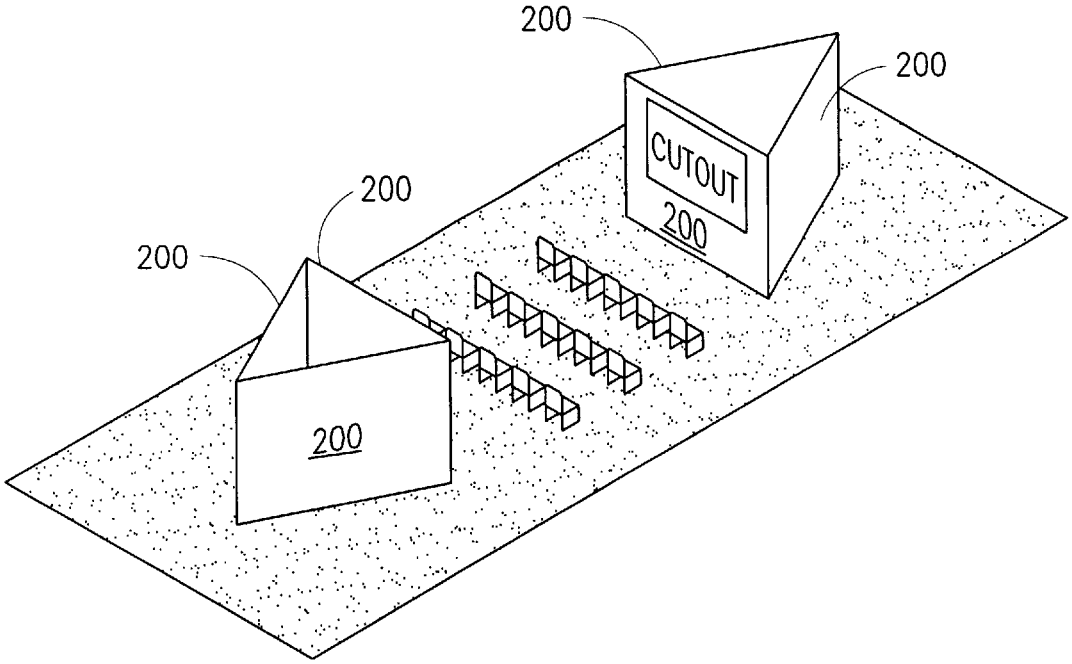

Referring to FIG. 12*i,* there is illustrated six of the portable exhibit systems used together to form a video monitor theater. The video monitor theater enables the placement of a video monitor within a cut-out of one of the display surfaces. It should be understood that the video monitor can be used in many of the other configurations that have been and will be described.

Figure 12J:
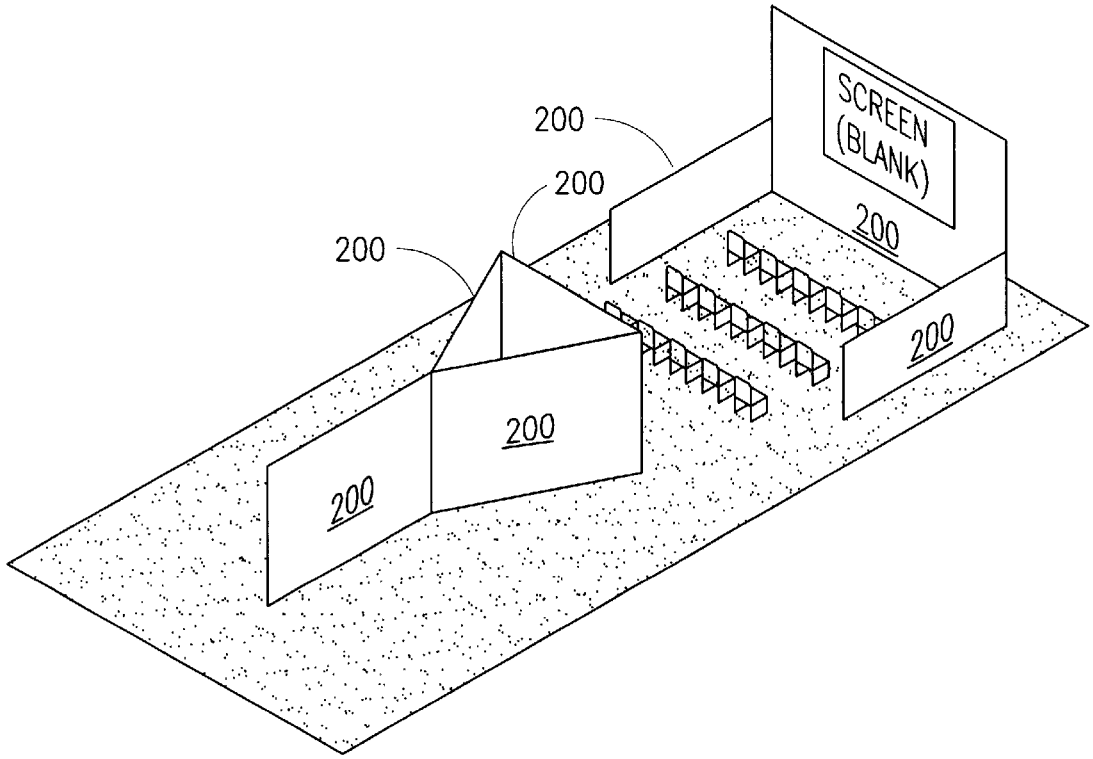

Referring to FIG. 12*j,* there is illustrated seven of the portable exhibit systems used together to form a software demo theater. The software demo theater enables a projector coupled with a laptop computer (for example) to project images on to one of the display surfaces having a non-printed zone or white surface. Again, it should be understood that projectors can be used in many of the other configurations that have been and will be described.

Figure 12K:
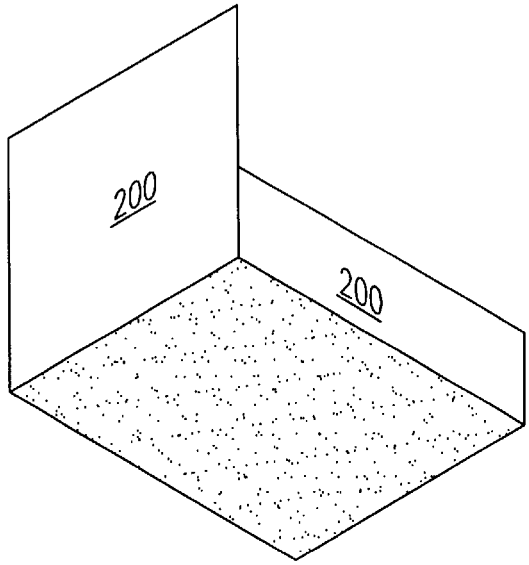
Figure 12L:
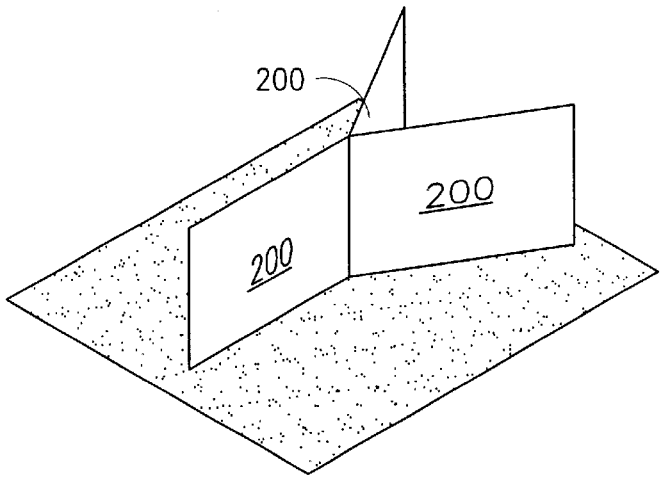

Referring to FIG. 12*k,* there is illustrated two of the portable exhibit systems used together to form a corner complete display. The corner complete display includes two portable exhibit systems each having different sizes to effectively utilize a corner location of an exhibit area.

Referring to FIG. 121, there is illustrated three of the portable exhibit systems used together to form a 'Y' storage display. The 'Y' storage display effectively doubles the total viewable display area without sacrificing any of the storage area, as compared to the 'V' storage display (see FIG. 12*e*).

Figure 12M:
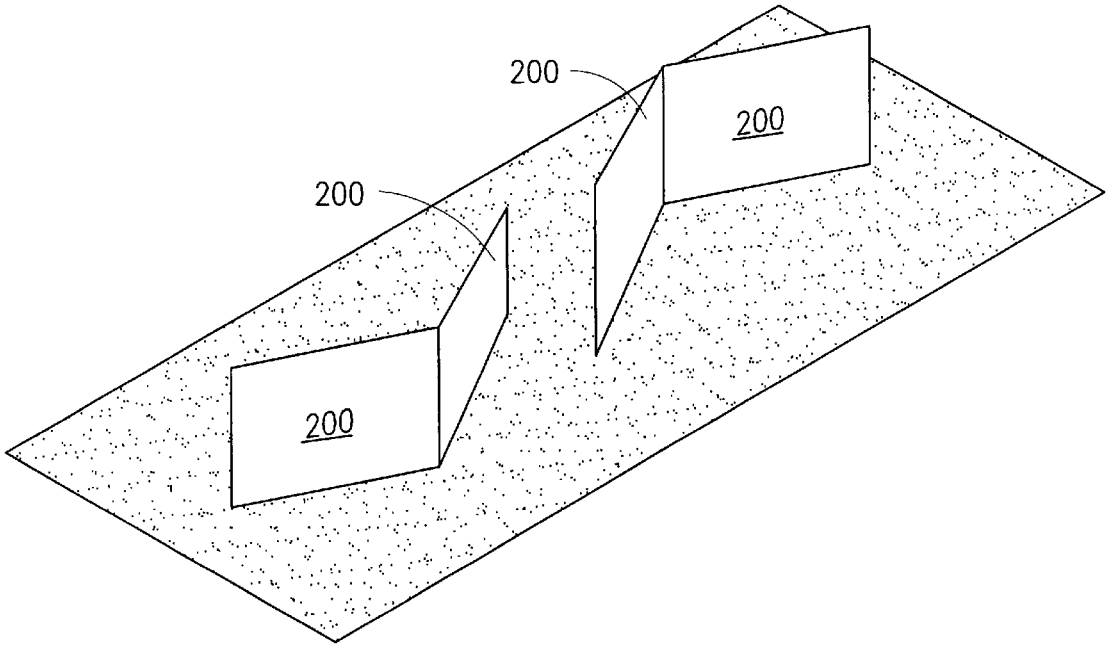

Referring to FIG. 12*m,* there is illustrated four of the portable exhibit systems used together to form a "great wall" display. The "great wall" display could be used for displaying the products and information of multi-divisional companies.

From the foregoing, it can be readily appreciated by those skilled in the art that the present invention provides a portable exhibit system that is inexpensive (disposable), lightweight, easily to assemble and disassemble when compared to traditional exhibit systems. Also, the portable exhibit system disclosed is downwardly modular such that the components of more elaborate displays can also be used to build less elaborate displays. Lastly, it was disclosed how several of the portable exhibit systems can be combined with one another to create different types of custom displays.

Although exemplary embodiments of the apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A graphic panel comprising:

a display surface including a first pole pocket along an upper edge, said first pole pocket having a first end and a second end and comprising at least one notch disposed between said first and second ends;

a first plurality of poles that are connected to one another and inserted into the first pole pocket;

at least one hanger removably attached to said plurality of poles at the at least one notch, wherein said at least one hanger aids in the hanging of said graphic panel; and wherein said at least one notch is adapted to aid in the insertion of said first plurality of poles into the first pole pocket.

2. The graphic panel of claim 1, wherein said at least one notch is adapted to receive a post member of a collapsible frame to engage the first plurality of poles such that the post member is obscured behind the display surface.

3. The graphic panel of claim 1, further comprising:

said display surface further includes a second pole pocket substantially parallel to said first pole pocket; and a second plurality of poles that are connected to one another and inserted into the second pole pocket, wherein said first plurality of poles and second plurality of poles enable said display surface to hang relatively straight.

4. The graphic panel of claim 3, wherein said second pole pocket further includes at least one notch for aiding the insertion of said second plurality of poles into the second pole pocket.

5. A graphic panel comprising:

a display surface including a first pole pocket along an upper edge, said first pole pocket having a first end and a second end and comprising at least one notch disposed between said first and second ends;

a first plurality of poles that are connected to one another and inserted into the first pole pocket; said at least one notch is adapted to aid in the insertion of said first plurality of poles into the first pole pocket;

a second pole pocket substantially parallel to said first pole pocket;

a second plurality of poles that are connected to one another and inserted into the second pole pocket, wherein said first plurality of poles and second plurality of poles enable said display surface to hang relatively straight;

a third pole pocket;

a third plurality of poles including a third cord located within said third plurality of poles that are connected to one another and inserted into the third pole pocket, wherein the second pole pocket and the third pole pocket are located at opposite ends of the display surface and the first pole pocket is located between the second pole pocket and the third pole pocket; and wherein said display surface further includes means for attaching the opposite ends of the display surface to one another.

* * * * *